US007128227B2

(12) United States Patent
Skillin et al.

(10) Patent No.: US 7,128,227 B2
(45) Date of Patent: Oct. 31, 2006

(54) DISPENSING CLOSURE WITH STOP WALL FOR POSITIVE ALIGNMENT ON CONTAINER

(75) Inventors: Clifford W. Skillin, Blackstone, MA (US); Joseph F. Johnson, Woodstock, CT (US)

(73) Assignee: Polytop Corporation, Slatersville, RI (US)

( * ) Notice: Subject to any disclaimer, the term of this patent is extended or adjusted under 35 U.S.C. 154(b) by 122 days.

(21) Appl. No.: 10/664,871

(22) Filed: Sep. 22, 2003

(65) Prior Publication Data

US 2005/0061765 A1 Mar. 24, 2005

(51) Int. Cl.
*B65D 41/00* (2006.01)

(52) U.S. Cl. ..... 215/235; 215/44; 222/556

(58) Field of Classification Search ..... 222/556
See application file for complete search history.

(56) References Cited

U.S. PATENT DOCUMENTS

| | | | | |
|---|---|---|---|---|
| 3,263,850 | A | 8/1966 | Scott | |
| 3,458,052 | A * | 7/1969 | Kann | 211/193 |
| 3,893,583 | A | 7/1975 | McLaren | |
| 4,289,248 | A * | 9/1981 | Lynn | 215/330 |
| 4,301,937 | A | 11/1981 | Von Hagel | |
| 5,054,268 | A | 10/1991 | Hayes et al. | 53/490 |
| 5,096,083 | A | 3/1992 | Shaw et al. | |
| 5,143,234 | A | 9/1992 | Lohrman et al. | |
| 5,145,080 | A | 9/1992 | Imbery, Jr. | |
| 5,279,434 | A * | 1/1994 | Aguirrezabal | 215/331 |
| 5,386,918 | A * | 2/1995 | Neveras et al. | 215/235 |
| 5,547,091 | A * | 8/1996 | Neveras et al. | 215/237 |
| 5,690,242 | A | 11/1997 | Campbell, Jr. | |
| 5,699,922 | A | 12/1997 | Harding | |
| 5,806,698 | A * | 9/1998 | Aguirrezabal | 215/235 |
| 5,988,412 | A | 11/1999 | Minnette et al. | |
| 5,992,656 | A | 11/1999 | Dujardin et al. | |
| 6,105,801 | A * | 8/2000 | Minnette | 215/44 |
| 6,431,381 | B1 | 8/2002 | Randall | |
| 6,571,994 | B1 * | 6/2003 | Adams et al. | 222/521 |

FOREIGN PATENT DOCUMENTS

| | | |
|---|---|---|
| DE | 196 52 148 A1 | 6/1998 |
| EP | 0 621 199 A1 | 10/1994 |
| EP | 1 386 949 A1 | 4/2004 |

* cited by examiner

*Primary Examiner*—Robin A. Hylton
(74) *Attorney, Agent, or Firm*—Barlow, Josephs & Holmes, Ltd.

(57) ABSTRACT

A dispensing closure, including a horizontal deck, an aperture through the deck, and a collar depending below the aperture in the deck, is snapped over an annular bead on the neck of a molded plastic bottle. A stop wall, comprising a pair of ribs mounted for pivotal movement, is formed in the interior of the body of the closure; a gap is centrally located between the ribs. A radially projecting lug, which is triangular when viewed in side elevation, is formed on the sloping collar of the container; a dovetailed segment is defined at the free end of the lug. The collar on the closure has interrupted beads, so that the dispensing closure is secured to the container by snapping the interrupted beads over the annular bead on the neck of the container. The ribs of the stop wall flex pivotally outwardly when contacting the outer end of the lug. The dispensing closure is rotated relative to the container, in either the clockwise or counterclockwise direction, so that the dovetailed segment of the lug projects into the central aperture in the stop wall; the free ends of the ribs engage the dovetailed segment and lock the closure into proper alignment with the container.

17 Claims, 4 Drawing Sheets

DISPENSING CLOSURE WITH STOP WALL FOR POSITIVE ALIGNMENT ON CONTAINER

FIELD OF THE INVENTION

The invention pertains to dispensing closures, employing stop walls, that cooperate with a lug defined on the neck of a plastic container to establish positive alignment of the dispensing closure relative to the container.

BACKGROUND OF THE INVENTION

Dispensing closures, including lugs, stops, and the like, for positively aligning the closure relative to a specific location, on a plastic container, such as the front of a bottle, are known. To illustrate, U.S. Pat. No. 5,143,234, granted Sep. 1, 1992 to Richard Lohrman et al, discloses a dispensing closure (20), employing a living, or snap-acting, hinge (26), and utilizing an alignment rib (30) for providing a positive alignment of the thumb recess (14) for facilitating the lifting of a hinged closure lid (24). In the preferred embodiment of FIGS. 1–5, cooperating alignment ribs (30, 48) are located upon the bottle neck and the interior of the closure. The alignment ribs are interrelated in such a manner that when the closure is threaded up the bottle neck, the mating ribs do not contact one another in the first instance, but eventually contact and abut each other after at least one full turn of the closure upon the bottle neck, and before one and one-half full turns of the closure upon the bottle neck, thereby positioning the thumb recess (14) in the center of the bottle face, as shown in FIG. 4. The bottle face contains the brand name of the product, an advertisement for such product, fanciful graphics, etc. so that the proper alignment of the dispensing closure is of commercial significance.

Another positive orientation system for a dispensing closure, with an internally threaded skirt, and a closure, is shown in U.S. Pat. No. 5,145,080, granted Sep. 8, 1992, to Leo R. Imbery, Jr. The Imbery, Jr. patent discloses a container (30) having a neck (36) defining an opening (38) to the interior of the container, an external screw thread (50), and a protuberance (80). The protuberance has generally opposite abutment surfaces (leading surface 96, and trailing surface 98), and at least one cam surface (106, 110) extending between the abutment surfaces. The closure (32) has a skirt (44) defining an internal screw thread (48) for engaging the external screw thread on the container. The skirt defines a recess (82) for receiving a protuberance (80). The recess is defined at opposite ends by spaced-apart engaging surfaces (121, 122) for confronting the abutment surfaces of the protuberance. The skirt is sufficiently resilient, as shown in FIG. 6, to deform as relative threading engagement is effected between the closure and the container neck to accommodate relative movement of the container neck and closure until the protuberance is received in the recess, as shown in FIG. 5, to prevent relative rotation between the closure and the container.

Another positive orientation system for dispensing closures secured to plastic containers is disclosed in U.S. Pat. No. 6,431,381, granted Aug. 13, 2002, to Jeffrey T. Randall. In the preferred embodiment of FIGS. 1–5, Randall discloses a closure (30) having a lug seal (50) that cooperates with a container neck lug (28) formed on a shoulder (27) on an interior surface (25) of the container neck (26). In the alternative embodiment of FIGS. 6–11, Randall discloses a positive orientation system employing at least one neck lug (128) on an end of the container neck (121), and the closure body (132) is provided with at least the closure neck lug (154) extending from the closure neck, and adapted to engage a corresponding one of the at least one (usually two) neck lugs. The engagement of the lugs limits the threaded engagement between the closure and the container during installation of the dispensing closure, but permits unthreading removal of the closure from the container, when necessary or desirable.

SUMMARY OF THE INVENTION

It is an object of the invention to provide a versatile dispensing closure that is forced downwardly and snapped over a bead on the neck of the container, and is subsequently aligned to the neck of the container by a rotational movement. The dispensing closure relies upon interrupted beads, on the interior of a depending collar, to seat the closure.

It is another object of the invention to provide a dispensing closure with a stop wall situated in the interior of the closure for cooperation with a plastic container that is characterized by a radially extending lug, or stop. The dispensing closure is snapped into engagement with the neck of the container, and is then rotated until the deformable stop wall engages the lug, and captures same, to positively align for the cap relative to the body of the container.

Furthermore, it is an object of the invention to provide a unitary, molded plastic dispensing closure with a stop wall located in the interior of the dispensing closure between the skirt and the centrally located collar. A central opening or aperture divides the stop wall into two spaced ribs; each rib is flexible. The ribs deform, until the lug is seated in the central aperture, thereby defining the positively oriented, or aligned, position of the dispensing closure relative to the body of the container. One rib will flex if the closure is rotated to position in the clockwise direction, the other rib is flexed if the closure is rotated to aligned position in the counter clockwise direction.

Additionally, it is an object of the invention to provide a molded plastic dispensing closure with an internal stop wall that cooperates with a plastic container that utilizes a projecting lug located on the sloping collar of the container.

Lastly, it is an object of the invention to provide a unique method of securing the molded dispensing closure to the neck of the container in an aligned manner. The method, which is compatible with automated high speed assembly machines, includes the steps of (1) snapping an interrupted bead on the skirt of the dispensing closure over an annular bead on the neck of the container, (2) rotating the closure, (3) until the stop wall in the interior of the closure is seated upon the remote end of a radially projecting lug on the container. The stop wall is defined by a pair of flexible, pivotal ribs, and an aperture is formed between the free edges of the ribs to receive the lugs. The dispensing closure may be rotated in the clockwise, or counterclockwise, direction until the ribs engage the opposite sides of the radially projecting lug on the container and define the aligned position for the closure.

Yet other objects, and advantages, of the instant invention will become readily apparent to the skilled artisan, when the appended drawings are construed in harmony with the specification.

DETAILED DESCRIPTION OF THE PREFERRED EMBODIMENT

Figure 1:
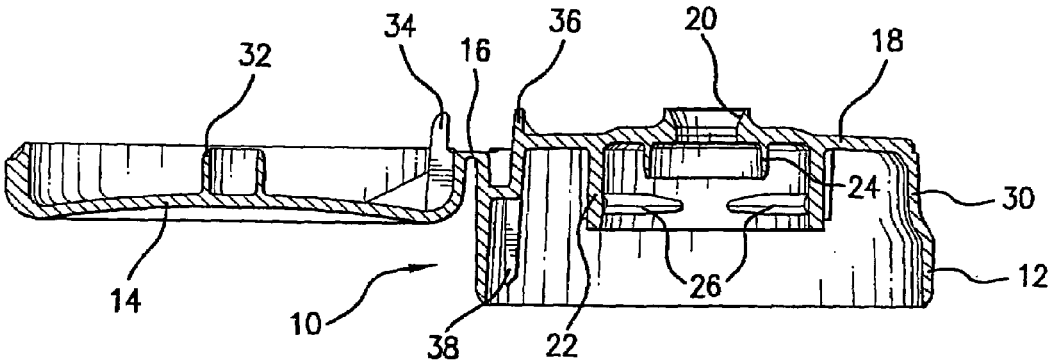
FIG. 1 is a vertical, cross-sectional view of a dispensing closure, constructed in accordance with the principles of the instant invention, showing the unique stop wall.
Figure 2:
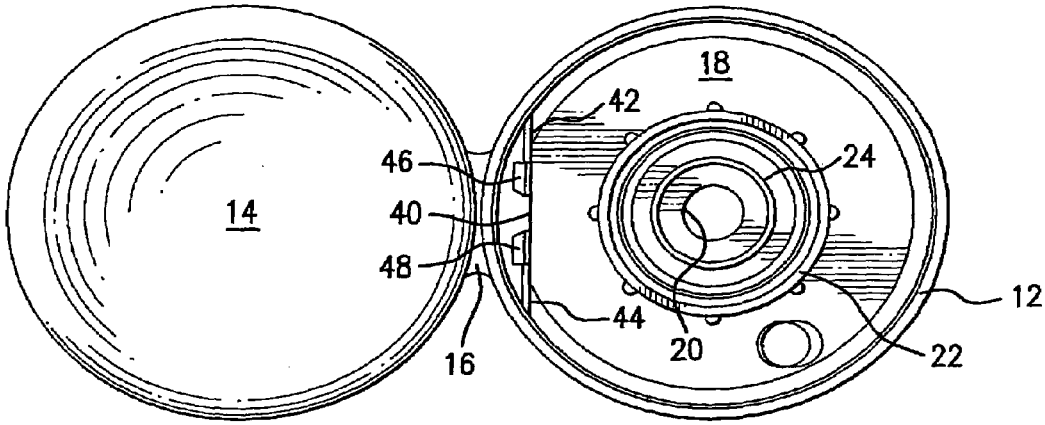
FIG. 2 is a bottom plan view of the dispensing closure of FIG. 1.

FIGS. 1 and 2 show an integrally molded dispensing closure 10 constructed in accordance with the principles of the instant invention. Dispensing closure 10 comprising a body 12, a lid 14, and a "living" hinge 16 for securing the lid to the body for pivotal movement relative thereto. Body 12 includes horizontally extending deck 18, with a centrally located aperture 20. An annular collar 22 depends below deck 18, and a plug seal 24 encircles aperture 20 and extends radially about the aperture. Interrupted beads 26 are spaced around the inner face of collar 22.

A recess 30, which receives the thumb, or other finger, of the user of the dispensing closure, is located at the "front" of the closure, diametrically opposite living hinge 16. When lid 14 is pivoted to its closed position, plug or spud 32 is pressed into central aperture 20 to seal same. When the lid is pivoted to its open position, it is retained in a position that does not impede the discharge of product through aperture 20. A camming lug 34 extends above hinge 16 and cooperates with cam surface 36 that extends above deck 18 on body 12, to stress hinge 16, within its resilient limits, to cause the lid to move, in a toggle-like manner, between its opened, and closed, positions.

Stop wall 38 is situated within the interior of body 12 of closure 10, between the exterior skirt and collar 22, as shown in FIG. 1. Stop wall 38 extends across the annular body of closure 10 in chord-like fashion, as shown in FIG. 2. A gap 40 is located in the central area of stop wall 38, to divide the stop wall into resilient ribs 42 and 44, of equal size. Reinforcing stays, 46, 48 may be used to rigidify the ribs 42, 44, and prevent excessive deformation.

Figure 3:
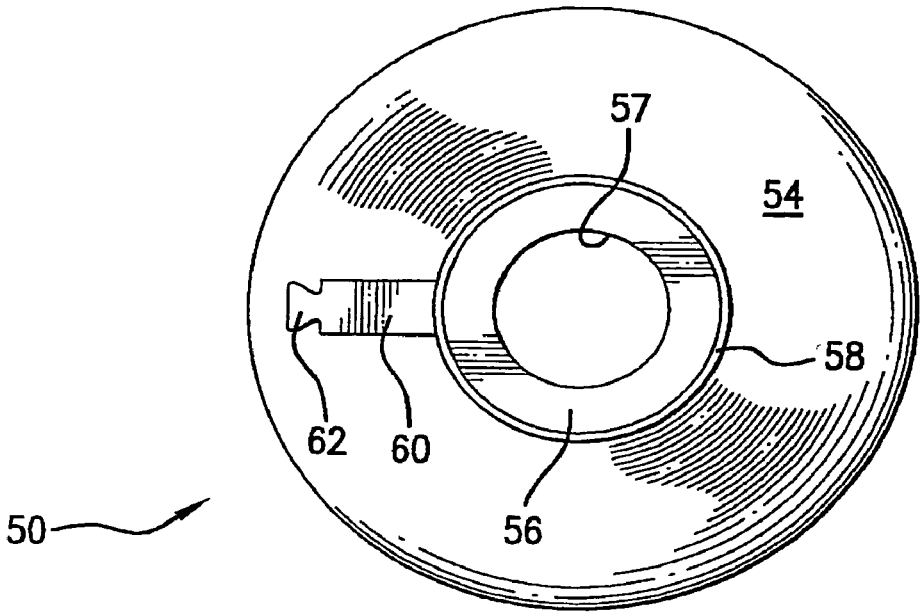
FIG. 3 is a top plan view of a container, constructed in accordance with the principles of the instant invention, showing the radially extending stop.
Figure 4:
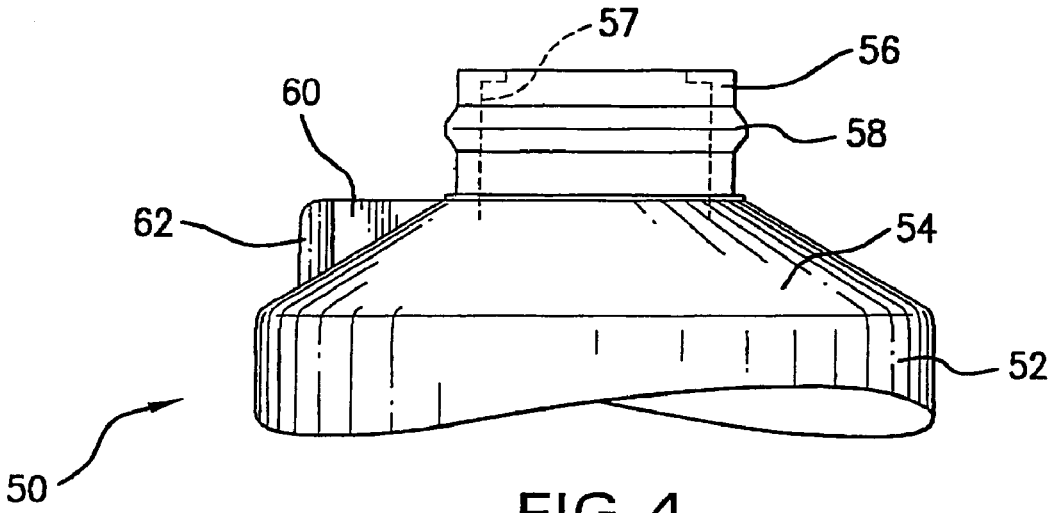
FIG. 4 is a side elevational view of the upper end of the container of FIG. 3 and a fragment of the container body.

FIGS. 3 and 4 depict a deformable plastic container 50 to which, or upon which, dispensing closure 10 is applied. Container 50 comprises a body 52, which may be cylindrical, a sloping collar 54, and a vertically extending neck, or finish, 56 that encircles a discharge passage 57. An annular bead 58 encircles neck 56, and a radially projecting lug 60 extends outwardly below neck 56. Lug 60 is triangular in shape, when viewed in side elevation, in FIG. 4. Triangular cut-outs are defined in opposing sides of lug 60, so that the lug terminates, at its outer or remote end, in a dovetailed segment 62.

Figure 5:
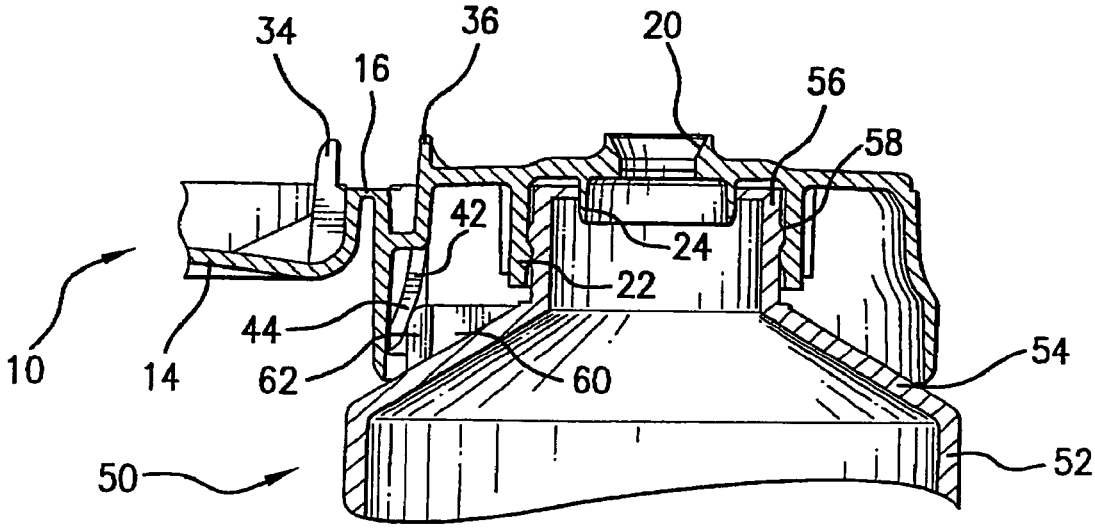
FIG. 5 is a side elevational view of the dispensing closure seated upon the container, with the lug on the container pressing one rib of the stop wall to pivot outwardly.

FIG. 5 shows collar 22 of dispensing closure 10 pressed downwardly so that interrupted beads 26 snap over annular bead 58 on neck 56 of container 50. The lower end of body 12 of closure 10 rests upon sloping collar 54. Rib 44 of stop wall 38 on dispensing closure 10 presses against the remote end 62 of lug 60, and pivots outwardly.

Figure 6:
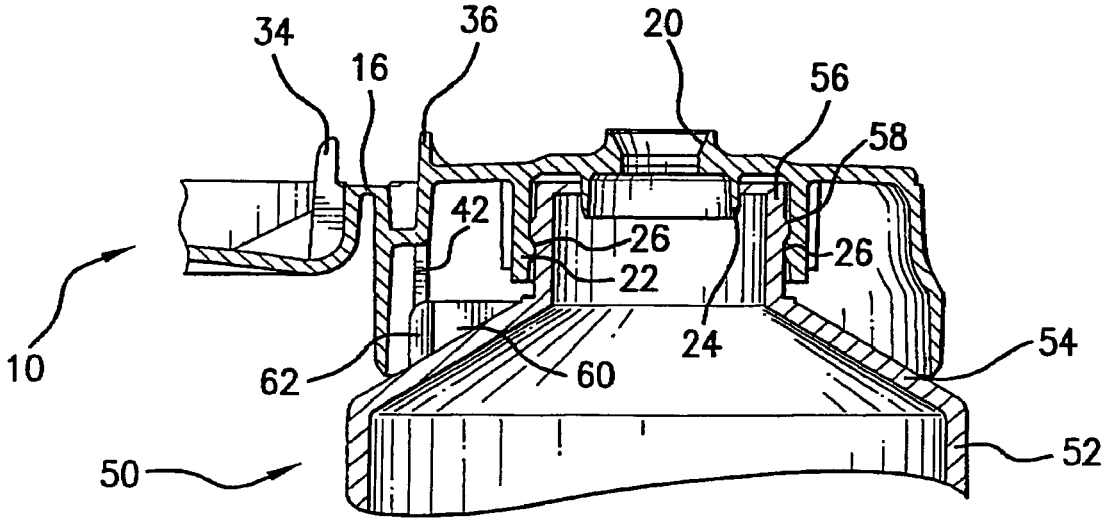
FIG. 6 is a side elevational view, similar to FIG. 5, but showing the lug on the container seated within the aperture in the stop wall.

FIG. 6 shows the position that the various structural components of the instant invention assume when a torque is applied to dispensing closure 10, after the closure has been seated upon container 50.

Figure 7:
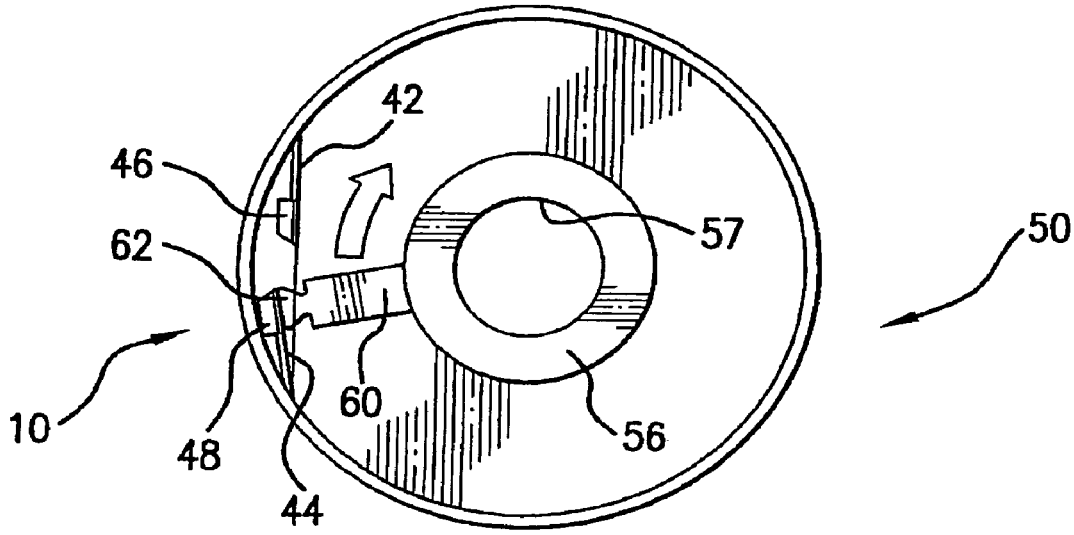
FIGS. 7 and 8 are schematic views, showing the manner in which the dispensing closure is rotated so that the lug on the container interacts with the stop wall to provide positive alignment for the closure.

FIG. 7 shows, in a schematic fashion, dispensing closure 10 snapped over bead 58 (not shown) on neck 56 of container 50. Stop wall 38 contacts dovetailed segment 62 of lug 60, and the lug forces rib 44 to flex outwardly. After closure 10 is seated, conventional capping apparatus applies a rotational force or torque to closure 20 to rotate same typically in a clockwise direction, as indicated by the directional arrow.

The clockwise rotation of closure 10 allows dovetailed segment 62 of lug 60 to become seated with gap 40 between ribs 42, 44 of stop wall 38. The cut-outs in the dovetailed shape of segment 62 receive, and seat, the free ends, or edges, of ribs 42, 44, to define the aligned position between dispensing closure 10 and container 50. The seating action is sufficiently robust so that continued rotational torque imparted by the capping apparatus, is insufficiently robust so that continued rotational torque imparted by the capping apparatus, is insufficient to overcome the seating action. The aligned position, in most instances, indicates that the recess 30 at the "front" of the closure is aligned with the front face of the container, which bears the brand name, product description, fanciful graphics, and other information relating to the product retained within the container.

Figure 8:
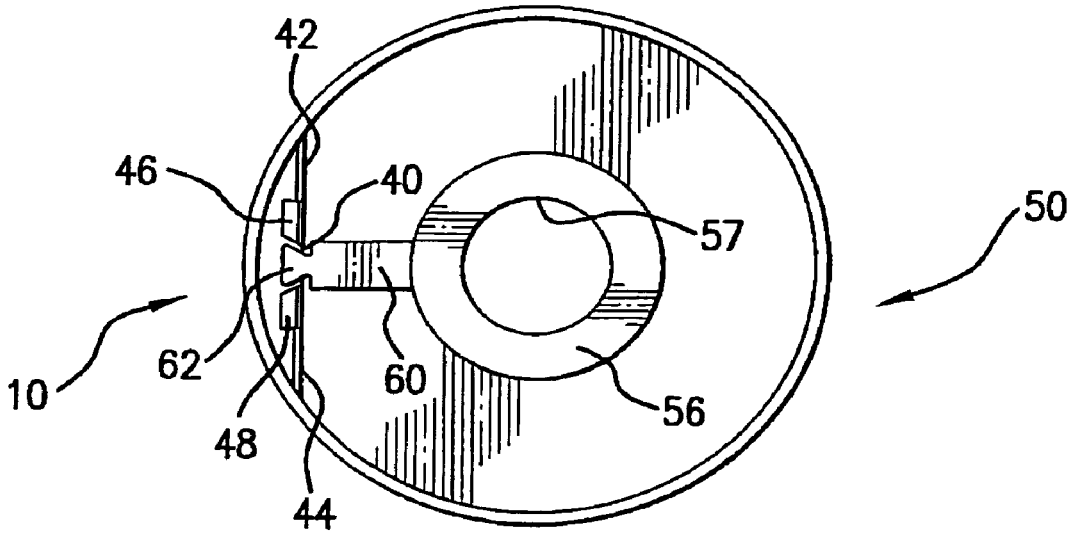

FIG. 8 shows dovetailed segment 62 on lug 60 retained in its "home" position by the engagement of the free ends of ribs 42, 44 with the cut-outs on opposite sides of dovetailed segment 62 on lug 60. The "home" position determines the positive alignment of dispensing closure 10 with container 50 so that recess 30 is situated at the "front" of the container, in alignment with the front label (not shown).

Modifications and revisions will readily occur to the skilled artisan; for example, the closure may be rotated counterclockwise, and segment 62 at the free end of lug 60 may assume a different shape. "Living" hinge 16 may be replaced by a plastic strap, or straps. Consequently, the appended claims should not be limited to their literal terms, but should be broadly construed in a manner consistent with the breadth of the invention.

What is claimed is:

1. In combination, a container and a dispensing closure secured to said container for discharging the contents thereof, a) said container comprising a container body, a sloping collar sloping inwardly and upwardly from said container body, and a neck extending above said sloping collar, b) a bead encircling said neck of said container, c) a lug formed on said sloping collar and extending radially outwardly and away from said neck, d) said dispensing closure comprising a closure body, a lid, and a hinge for securing said lid to said closure body for pivotal movement relative thereto, e) said dispensing closure further comprising a deck, an aperture through said deck, and an annular collar surrounding said aperture and depending below said deck, f) interrupted beads defined on the interior of said annular collar so that said annular collar may be snapped over said annular bead to seat the dispensing closure upon the container, g) a stop wall defined on a chord extending across the interior of the closure body of said dispensing closure, h) said stop wall including a pair of ribs separated by a central gap, one end of each rib being joined to the interior of said closure body of said dispensing closure to permit pivotal movement of each respective rib, and i) said stop wall cooperating with said lug to define a home position when said dispensing closure is rotated relative to said container after being seated thereon.

2. The combination of claim 1 wherein reinforcing stays are employed to strengthen said ribs comprising a pair of raised shoulders positioned on the respective ends of the ribs and adjacent to the central gap.

3. The combination of claim 1 wherein said lug is triangular when viewed in side elevation, the upper end of the lug extending parallel to, but spaced below, said annular bead on said container.

4. The combination of claim 1 wherein a segment is formed at the radially extending outer end of said lug by narrowing a portion of said lug to form the segment.

5. The combination of claim 4 wherein a triangular insert is removed from each of the opposite sides of said segment, thereby forming a dovetailed shape for said segment.

6. The combination of claim 5 wherein said dovetailed shape of said lug promotes locking of the closure in the home position, even when relatively high torques are applied to the dispensing closure.

7. The combination of claim 1 wherein a recess is formed in the closure body of said dispensing closure diametrically opposite said hinge, said recess enabling the user to lift said cap and pivot same away from said closure body.

8. In combination, a container and a dispensing closure secured to said container for discharging the contents thereof, a) the container comprising a container body, a sloping collar sloping inwardly and upwardly from the container body, and a neck extending above the sloping collar, b) a lug formed on the sloping collar and extending radially outwardly and away from the neck, c) the dispensing closure comprising a closure body having a deck an aperture through the deck, and an annular collar surrounding the aperture and depending below the deck, d) a stop wall defined on a chord extending across the interior of the closure body of said dispensing closure, the stop wall including a pair of ribs separated by a central gap, one end of each rib being joined to the interior of the closure body of the dispensing closure to permit pivotal movement of each respective rib, e) the stop wall cooperating with the lug to define a home position when the dispensing closure is rotated relative to the container after being seated thereon, and f) means for securing the dispensing closure to the container.

9. The combination of claim 8 wherein reinforcing stays are employed to strengthen said ribs comprising a pair of raised shoulders positioned on the respective ends of the ribs and adjacent to the central gap.

10. The combination of claim 8 wherein said lug is triangular when viewed in side elevation, the upper end of the lug extending parallel to, but spaced below, said annular bead on said container.

11. The combination of claim 8 wherein a segment portion is formed at the radially extending outer end of said lug by narrowing a portion of said lug to form the segment.

12. The combination of claim 11 wherein a triangular insert is removed from each of the opposite sides of said segment portion, thereby forming a dovetailed shape for said segment portion.

13. The combination of claim 12 wherein said dovetailed shape of said lug promotes locking of the closure in the home position, even when relatively high torques are applied to the dispensing closure.

14. The dispensing closure of claim 8 wherein the means for securing the dispensing closure to the container comprises interrupted beads defined on the interior of the annular collar which cooperate with an annular bead on the neck of the container.

15. A dispensing closure for a container, comprising:

a closure body having a deck, an aperture through the deck, and an annular collar surrounding the aperture and depending below the deck;

a stop wall defined on a chord extending across the interior of the closure body of the dispensing closure, the stop wall including a pair of ribs separated by a central gap, one end of each rib being joined to the interior of the closure body of the dispensing closure to permit pivotal movement of each respective rib; and means for securing the dispensing closure to the container.

16. The dispensing closure of claim 15 wherein reinforcing stays are employed to strengthen said ribs comprising a pair of raised shoulders positioned on the respective ends of the ribs and adjacent to the central gap.

17. The dispensing closure of claim 15 wherein the means for securing the dispensing closure to the container comprises interrupted beads defined on the interior of the annular collar which cooperate with an annular bead on the neck of the container.

* * * * *